United States Patent [19]

Newton

[11] 4,443,949

[45] Apr. 24, 1984

[54] PICTURE-HANGING TEMPLATE

[76] Inventor: Charles Newton, 1000 San Pasqual St., Apt. #14, Pasadena, Calif. 91106

[21] Appl. No.: 434,839

[22] Filed: Oct. 18, 1982

[51] Int. Cl.[3] ..... G01B 3/14

[52] U.S. Cl. ..... 33/180 R; 33/174 G; 33/191; 248/498

[58] Field of Search ..... 33/180 R, 174 G, 191; 248/475 R, 466, 498, 497, 490, 479

[56] References Cited

U.S. PATENT DOCUMENTS

| | | | |
|---|---|---|---|
| 1,121,290 | 12/1914 | Robinson | 33/180 R |
| 2,241,692 | 5/1941 | Williams | 33/180 R |
| 2,387,986 | 10/1945 | Evans | 33/180 R |
| 2,641,427 | 6/1953 | Krogh | 33/174 G |
| 2,799,093 | 7/1957 | Miller | 33/180 R |
| 2,816,366 | 12/1957 | Barlow | 33/180 R |
| 3,156,984 | 11/1964 | Palmer | 33/174 G |
| 3,350,591 | 9/1970 | Moffitt | 33/180 R |
| 4,212,110 | 7/1980 | Hill, Jr. | 33/180 R |
| 4,241,510 | 12/1980 | Radecki | 33/180 R |

FOREIGN PATENT DOCUMENTS

| | | | |
|---|---|---|---|
| 65809 | 3/1914 | Austria | 248/498 |
| 303775 | 7/1915 | Fed. Rep. of Germany | 248/498 |

*Primary Examiner*—Willis Little

*Attorney, Agent, or Firm*—Fulwider, Patton, Rieber, Lee & Utecht

[57] ABSTRACT

A specially constructed template is provided for use in hanging wall-supported members, such as framed pictures, paintings, and the like. The template comprises an elongated body including two mirror imaged arrays of closely spaced holes distributed symmetrically on opposite sides of the longitudinal center of the template and in association with corresponding indicia to indicate the spacing of each hole from the center. The template is used to mark a wall-supported member and the wall at corresponding aligned locations so that specially configured two-part fasteners may be secured to the wall supported member and the wall in positions for mating alignment thereby permitting the wall-supported member to be hung in a stable manner and in a desired position on the wall.

26 Claims, 8 Drawing Figures

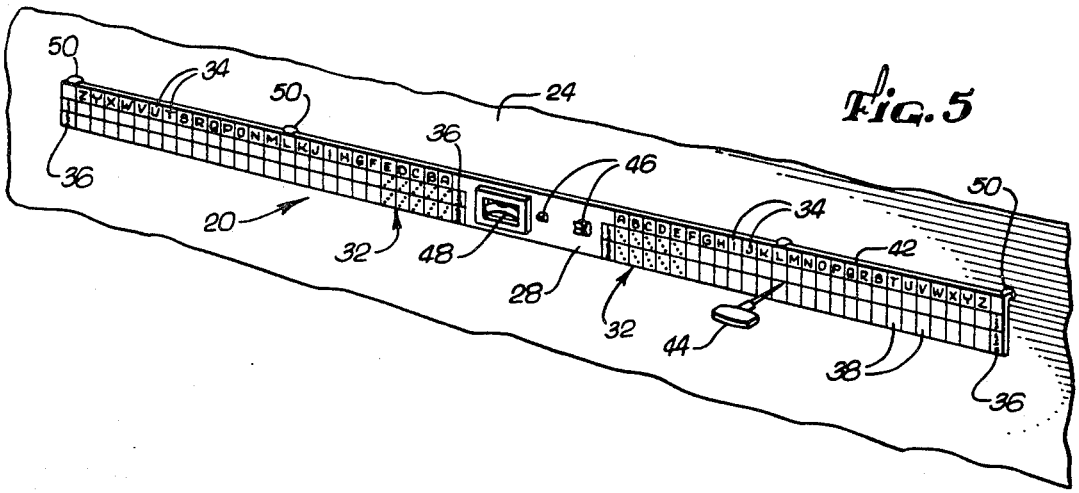
Fig. 5
Fig. 7
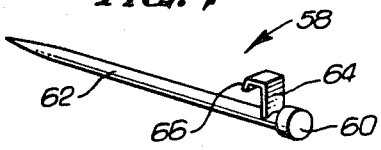
Fig. 6
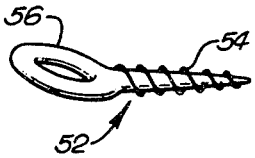
Fig. 8
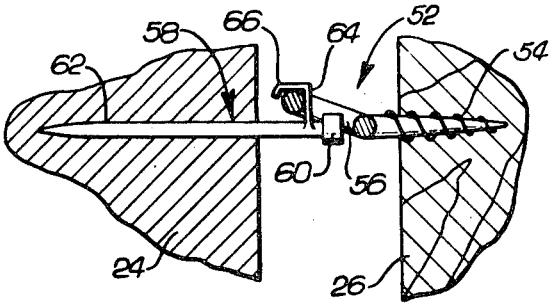

PICTURE-HANGING TEMPLATE

BACKGROUND OF THE INVENTION

The present invention relates to a device for use in hanging wall-supported members, such as framed pictures, mirrors, paintings, and the like. More particularly, the present invention relates to a device and method for hanging a wall-supported member quickly, easily, in a level orientation, and in a stable manner wherein it will not slip from level alignment.

A variety of picture hanging methods and devices are known in the art. One simple approach is to drive a fastener, such as a nail, into the wall and attach it to an eye screw, hook or other appropriate structure at the back of a frame, typically at the top center thereof. This method, although simple, has several major disadvantages. For example, extremely careful measurements are necessitated to locate the eye screw or hook at the vertical centerline of the frame, or the picture will be hung somewhat off-level. Moreover, while friction of the frame against the wall can aid in holding the frame in a level orientation, the use of a single suspension point results in a relatively unstable support which permits shifting of the frame to an off-level condition in response to any significant vibration source, such as closing of a door or the like.

An improved and relatively more common technique for hanging pictures involves stretching a support wire between two fasteners secured to the back of the frame and hanging the support wire from one or more nails or the like driven into the wall. However, this method undesirably requires several precise measurements if the picture is to be hung in a level orientation at the desired vertical position on the wall. That is, the position and orientation of the picture on the wall is affected by the length and elasticity of the support wire, the position and spacing of the fasteners secured to the frame, and the position and spacing of the nails driven into the wall, wherein incorrect consideration of any one of these factors can result in an improperly hung picture which is particularly noticeable when several pictures are hung side by side.

The use of a support wire, however, advantageously permits the picture to be adjusted on the wall until a level orientation is reached. Unfortunately, the support wire does not lock the picture in a stable, level orientation even when the wire is suspended from more than one nail driven into the wall. To the contrary, the picture is subject to occasional shifting in response to vibrations whereby periodic leveling of the picture is required. This can be particularly time-consuming and tedious task in homes or institutions having a large number of pictures requiring leveling.

Accordingly, there has existed a need for a fast, simple, and effective means for hanging pictures and the like in a stable and level orientation on a wall. As will become apparent from the following, the present invention satisfies this need and provides further related advantages.

SUMMARY OF THE INVENTION

The present invention resides in a specially constructed and relatively inexpensive template and kit for use in mounting framed pictures or other wall-supported members in a stable and permanently level orientation on a wall. The template is particularly designed for use with a pair of improved two-part fasteners for securing the fastener parts in aligned relation respectively into the wall-supported member and the wall, whereupon the fastener parts of the pair of fasteners can be interengaged to suspend the wall-supported member in a stable, level position.

In a preferred form of the invention, the template comprises an elongated, relatively thin stick-like body having a generally rectangular front face. The template body defines two mirror image arrays of closely spaced holes distributed symmetrically on opposite sides of the longitudinal center of the template, wherein individual holes within each array are identified and associated with corresponding holes in the other array equidistant from the template center by means of indicia, such as an alphanumeric code imprinted on the front face of the template body.

In use, the template is positioned on the back of a picture frame or the like in an orientation generally parallel with a horizontal axis of the frame. This orientation is conveniently obtained by placement of a relatively short flange projecting rearwardly from the upper longitudinal margin of the template body against an upper horizontal edge of the picture frame. The template is then slid longitudinally back and forth relative to the frame until a pair of the holes equidistant from the template centerline are symmetrically disposed relative to a vertical centerline of the picture frame. The frame is then marked by insertion of a marking tool, such as a awl or pencil, through the selected pair of template holes.

A pair of mating two-part fasteners, which may be specially adapted for use with the template of this invention, is secured respectively to the frame and the wall at the appropriately marked positions. The frame then may be hung on the wall by interengagement of the mating fastener parts which provide two horizontally spaced fixed suspension poins for maintaining the picture in a stable and permanently level orientation.

In the preferred form, the template body is manufactured from a relatively lightweight and inexpensive transparent plastic material which permits the frame to be viewed through the template body during the step of marking the frame. The template may further include support structure, such as spring clips or the like, for releasably mounting the marking tool when not in use.

The specially adapted two-part fasteners preferably comprise two fastener parts suited for respective attachment to the wall and the particular picture frame material and for horizontally aligned interengagement with each other. In one form, each two-part fastener comprises a nail member having a pointed shaft for driving into the wall and including an upwardly extending catch near its head. The nail member is engageable with a hook member, such as an eye screw having a threaded shank for securement to the picture frame and an eye oriented at an obtuse angle relative to the threaded shank. The angle of the eye is selected for locking engagement with the nail member catch, with the shaft of the nail member and the threaded shank of the hook member generally coaxially aligned.

Other features and advantages of the present invention will become apparent from the following detailed description and accompanying drawings, which illustrate, by way of example, the principles of the invention.

BRIEF DESCRIPTION OF THE DRAWINGS

The accompanying drawings illustrate the invention. In such drawings:

FIG. 1 is a pictorial perspective view illustrating a template embodying the novel features of the present invention in association with a wall-supported member, such as a framed picture or the like;

FIG. 5 is a pictorial perspective view illustrating the template in association with a wall;

FIGS. 6 and 7 illustrate in perspective form mating parts of a two-part fastener specially adapted for use with the template of this invention, and FIG. 8 is a fragmented elevation view, with portions thereof shown in vertical section, illustrating interengagement of the two-part fastener of FIGS. 6 and 7.

DETAILED DESCRIPTION OF THE PREFERRED EMBODIMENT

Figure 1:
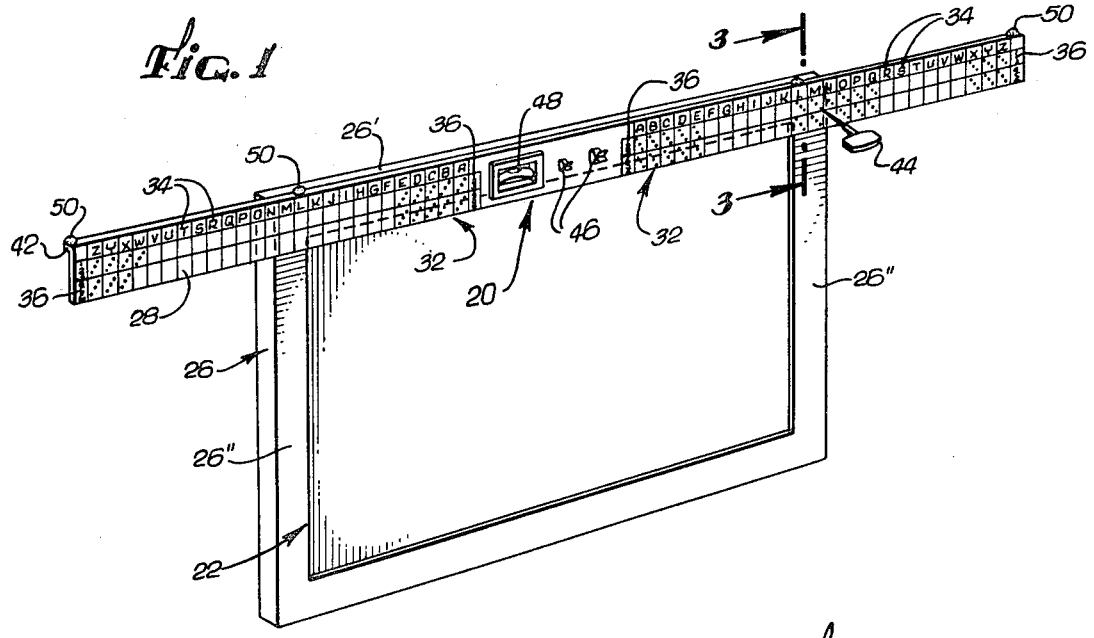

As shown in the exemplary drawings, a template referred to generally by the reference numeral 20 is provided for quickly and easily hanging a wall-supported member 22, such as a framed picture, mirror, painting, or the like, on a wall 24. The template 20 facilitates attachment of at least two interengageable two-part fasteners respectively to the frame 26 of the wall-supported member 22 and to the wall 24 for suspending the wall-supported member in a stable and permanently level orientation.

The template 20 advantageously provides a relatively simple, inexpensive, and easy-to-use device for rapidly hanging framed pictures and the like in a secure, level orientation without requiring time-consuming precise measurements of any kind. The template 20 thus overcomes the many problems and disadvantages associated with conventional picture-hanging devices and methods wherein the picture is all-too-frequently hung in an off-level condition, or alternatively the picture can be shaken or jostled to an off-level condition whereby periodic picture realignment is necessary.

The template 20 is shown in detail in FIGS. 1–4 to include an elongated and relatively thin, stick-like body 28 formed from a lightweight and advantageously transparent material, such as plastic or the like. As illustrated in FIG. 1, the template body 28 has a length typically on the order of about two to three feet sufficient to extend beyond the side margins of a frame 26 having a width within a range of relatively standard frame widths for a wall-supported member.

The template 20 has a generally rectangular front face interrupted by two mirror image or symmetrical arrays 32 of closely spaced holes extending from a point near the longitudinal center of the template body toward the opposite ends thereof. These hole arrays 32 are associated respectively with visible indicia imprinted on the front face of the template body 28, such as the exemplary alphanumeric code letters 34 and numerals 36 to identify corresponding pairs of holes in the two arrays 32 at equal distances from the centerline.

Figure 2:
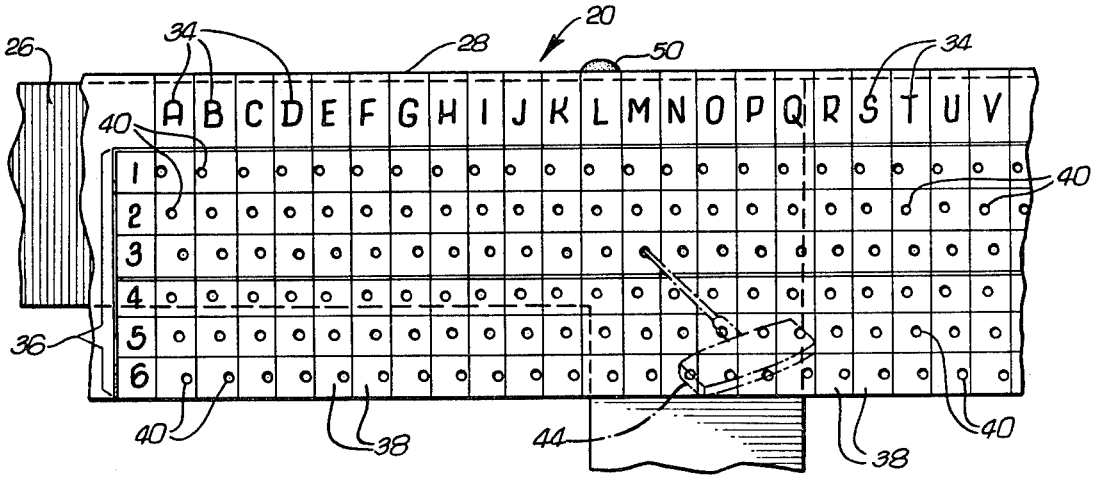
FIG. 2 is an enlarged fragmented front elevation view of a portion of the template shown in FIG. 1 and illustrating marking holes formed therein.
Figure 4:
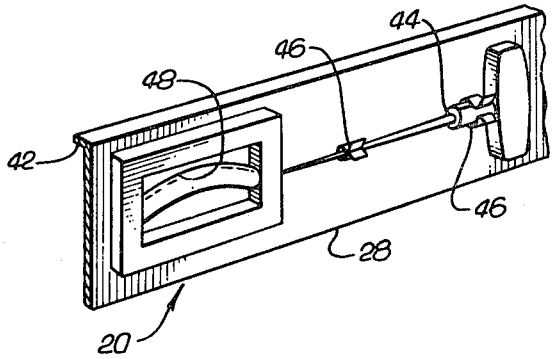
FIG. 4 is an enlarged fragmented front elevation view portion of the template illustrating a level indicator and a marking tool.
Figure 3:
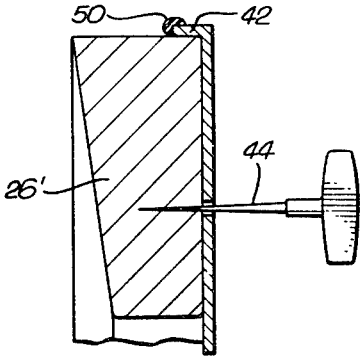
FIG. 3 is an enlarged fragmented vertical section taken generally along line 3—3 of FIG. 1.

More specifically, as illustrated in one preferred geometry in FIGS. 1 and 2, each of the hole arrays 32 is divided into a plurality of vertically arranged groups 38 of relatively small holes 40 wherein each group 38 is associated with a letter proceeding in sequence from the letter "A" near the longitudinal center of the template body to the letter "Z" near the associated end of the template body. Each group 38 of the holes 40 in turn comprises a plurality of vertically spaced holes, six of which are shown in FIG. 2, staggered slightly in the longitudinal direction relative to each other and individually associated with vertically spaced numerals, such as the numerals "1" through "6" at the associated end of the template body 28.

The two arrays 32 facilitate rapid and easy marking of the frame 26 at two points disposed symmetrically relative to a vertical centerline of the frame for symmetric attachment of a fastener component for use in hanging the frame from the wall 24. More particularly, marking of the frame 26′ is accomplished by aligning the template body 28 to overlie and to extend in parallel with the upper leg 26 of a conventional rectangular frame for a picture. Such alignment is facilitated by a relatively short flange 42 projecting rearwardly from the upper margin of the template body to engage the upper margin of the upper frame leg 26′, as viewed in FIG. 3. The template body 28 is then shifted laterally relative to the frame 26′ until the template centerline coincides with the vertical centerline of the frame, as indicated when identically coded portions of the mirror image hole arrays 32 are aligned with the opposed side legs 26″ of the frame 26. When alignment is achieved, two holes 40 in the two arrays 32 positioned equidistantly from the template longitudinal centerline and overlying the frame side legs 26″ are selected, and a marking tool 44, such as a pointed awl, is passed through these selected holes to mark the frame at two symmetrically disposed points. This marking tool 44, which may take other forms, such as a pencil or the like, conveniently may be supported on the template body 28 by spring clips 46 or the like when not in use, as viewed in FIG. 4.

The holes 40 in each array 32 are closely spaced longitudinally normally to provide more than one hole 40 overlying the frame side legs 26″ for marking purposes. For example, in a preferred form of the invention, the holes 40 are sized each to have a diameter of approximately 5/32 inch but are arranged in a vertically staggered configuration with a longitudinal center-to-center spacing less than their diameters and preferably on the order of about 2/32 inch. With this arrangement, if one or more of the holes align with imperfections, cracks, or joints in the frame, as are frequently encountered with conventional wood frames, alternate holes are available for marking the frame at a slightly different location.

After the frame 26 is marked as described above, the template 20 is used to mark the wall 24 at a pair of points having a spacing identical to the spacing of the marks on the frame. That is, as viewed in FIG. 5, the template body 28 is placed against the wall 24 with its flange 42 at an elevation corresponding with the desired location of the picture to be hung. The template body 28 is adjusted in position until a horizontal orientation is achieved, as indicated by a spirit level 48 or other suitable level indicating device mounted on the template body near the longitudinal center thereof, after which the marking tool 44 is passed through the same two holes 40 of the two mirror image arrays 32 as those used to mark the frame to make an identically spaced pair of marks on the wall. Resilient tabs 50 secured to the rearmost ends of the template flange 42 conveniently prevent slipping or skidding of the template during this marking process to avoid scratching or marring of the wall.

The marks applied to the frame 26 and the wall 24 indicate attachment points for a pair of two-part fasteners. More particularly, the marks on the frame 26 indicate attachment points for hook members or the like for interengagement with a corresponding pair of nail members or the like driven into the wall at the points indicated by the marks applied to the wall. After the hook and nail members have been appropriately attached to the frame and the wall, the picture may be quickly and easily hung in a stable and permanently level orientation by interengagement of the hook and nail members.

One preferred two-part fastener particularly adapted for use with the template 20 is illustrated in FIGS. 6–8 to include a hook member 52 in the form of an eye screw having a threaded shank 54 for attachment to the frame 26 and an eye 56 offset at an oblique angle relative to the axis of the shank 54. This eye screw is adapted for locking engagement with a nail member 58 having a head 60 and a pointed shaft 62 for driving into the wall in a conventional manner at the points marked thereon. The nail member 58 further includes an upwardly projecting catch 64 secured thereto near the head 60 as by welding, wherein this catch 64 terminates in a tip 66 directed toward the wall.

In use, the hook member 52 and the nail member 58 are respectively secured to the frame 26 and the wall 24, with the eye 56 angling upwardly and the catch 64 projecting upwardly, as viewed in FIG. 8. The eye 56 is then interengageable with the catch 64 on the nail member 58 to position the hook member shank 54 and the nail member shaft 62 in generally coaxial alignment with one another. Accordingly, with this particular two-part fastener construction, the nail member and hook member hold the attachment points on the frame and the wall at the same vertical plane whereby the template markings provide an accurate indication of the picture relative to the wall.

The template 20 and associated two-part fastener of this invention thus permit rapid and easy hanging of a wall-supported member in a secure and permanently level level position which will not change or move out of position as a result of bumping, vibrations, or the like. Time-consuming and tedious measurements are avoided. Accordingly, one or more pictures or the like can be hung quickly with confidence that the picture will be properly oriented on the wall in an attractive manner without fear of the pictures being off-level.

While a particular form of the invention has been illustrated and described, it will be apparent that various modifications can be made without departing from the spirit and scope of the invention. Accordingly, no limitation on the invention is intended, except by way of the appended claims.

What is claimed is:

1. A template for use in marking fastener attachment points on a wall and a wall-supported member to be hung on the wall, comprising:

an elongated template body having two visibly distinguishable and substantially mirror image arrays of longitudinally spaced holes formed therein on opposite sides of the longitudinal center thereof, each of said holes of one of said arrays being correlated with a corresponding one of said holes of the other of said arrays to provide a plurality of correlated pairs of holes substantially equidistant from the longitudinal center of the template body, whereby a selected one of said correlated pairs of holes is usable to mark an identically spaced pair of attachment points on the wall and the wall-supported member.

2. The template of claim 1 wherein each of said arrays of holes includes a plurality of groups of holes arranged generally normal to the longitudinal direction and having a longitudinal spacing relative to each other.

3. The template of claim 2 wherein the longitudinal spacing between said holes of each of said arrays is less than the diameters of said holes.

4. The template of claim 1 wherein said template body is formed from a transparent material.

5. The template of claim 1 further including means forming a flange along one longitudinal edge of said template body and projecting a relatively short distance substantially perpendicular to said template body.

6. The template of claim 5 including a plurality of relatively resilient, nonskid tabs carried by said flange means.

7. The template of claim 1 including a level indicator mounted on said template body.

8. The template of claim 1 including a marking tool for insertion through said selected one of said correlated pairs of holes to mark identically spaced pairs of attachment points on the wall and the wall-supported member, and means for removably mounting said marking tool on said template body.

9. The template of claim 1 wherein said template body includes indicia means for identifying said correlated pairs of holes substantially equidistant from the longitudinal center of the template body.

10. A template for use in marking fastener attachment points on a wall and a wall-supported member to be hung on the wall, comprising:

an elongated template body having two substantially mirror image arrays of longitudinally spaced holes formed therein on opposite sides of the longitudinal center thereof;

a flange formed along one longitudinal edge of said template body and projecting a relatively short distance substantially perpendicular to said template body;

a level indicator mounted on said template body; and indicia means on said template body for correlating each of said holes of one of said arrays with a corresponding one of said holes of the other of said arrays to identify a plurality of correlated pairs of hole substantially equidistant from the longitudinal center of the template body, whereby a selected one of said correlated pairs of holes is usable to mark an identically spaced pair of attachment points on the wall and the wall supported member.

11. The template of claim 10 wherein each of said arrays of holes includes a plurality of groups of holes arranged generally normal to the longitudinal direction and having a longitudinal spacing relative to each other.

12. The template of claim 11 wherein the longitudinal center-to-center spacing between said holes of each of said arrays is less than the diameters of said holes.

13. The template of claim 10 wherein said template body is formed from a transparent material.

14. The template of claim 10 including a purality of relatively resilient, nonskid tabs carried by said flange.

15. The template of claim 10 including a marking tool for insertion through said selected one of said correlated pairs of holes to mark identically spaced pairs of attachment points on the wall and the wall-supported member, and means for removably mounting said marking tool on said template body.

16. The template of claim 10 wherein said indicia means comprises an alphanumeric code.

17. A template for use in marking fastener attachment points on a wall and a wall-supported member to be hung on the wall, comprising:

an elongated transparent template body having two substantially mirror image arrays of longitudinally spaced holes formed therein on opposite sides of the longitudinal center thereof, each of said arrays being subdivided into a plurality of groups of holes arranged generally normal to the longitudinal direction and having a longitudinal spacing less than the diameters thereof;

a flange formed along one longitudinal edge of said template body and projecting a relatively short distance substantially perpendicular to said template body;

a plurality of relatively resilient, nonskid tabs carried by said flange;

a level indicator mounted on said template body;

indicia means on said template body for correlating each of said holes of one of said arrays with a corresponding one of said holes of the other of said arrays to identify a plurality of correlated pairs of holes substantially equidistant from the longitudinal center of the template body, whereby a selected one of said correlated pairs of holes is usable to mark an identically spaced pair of attachment points on the wall and the wall supported member; and a marking tool for insertion through said selected one of said correlated pairs of holes to mark identically spaced pairs of attachment ponts on the wall and the wall-supported member, and means for removably mounting said marking tool on said template body.

18. A kit for use in hanging a wall-supported member on a wall, comprising:

an elongated template body having two substantially mirror image arrays of longitudinally spaced holes formed therein on opposite sides of the longitudinal center thereof, each of said holes of one of said arrays being correlated with a corresponding one of said holes of the other of said arrays to provide a plurality of correlated pairs of holes substantially equidistant from the longitudinal center of said template body;

a pair of two-part fasteners each including a first part for attachment to the wall-supported member and a second part for attachment to the wall and interengageable by said first part to hang the wall-supported member from the wall; and marking means for passage through a selected one of said correlated pairs of holes to mark an identically spaced pair of attachment points in the wall-supported member and on the wall for respective attachment of said first and second fastener parts.

19. The kit of claim 18 further including a flange formed along one longitudinal edge of said template body and projecting a relatively short distance substantially perpendicular to said template body, said flange and template body being adapted to fit against the wall-supported member, and further including indicia means for use in centering said flange and template body relative to the wall-supported member.

20. The kit of claim 19 further including level indicating means on said template body for indicating when said template body is in a substantially horizontal orientation.

21. The kit of claim 18 further including means for removably mounting said marking tool on said template body.

22. The kit of claim 18 wherein said first and second fastener parts are interengageable to support the wall supported member relative to the wall with their respective attachment points in substantial alignment with each other.

23. For use in hanging a wall-supported member on a wall, a two-part fastener comprising:

a first fastener part for attachment to the wall-supported member at a selected attachment point thereon;

a second fastener part for attachment to the wall at a selected attachment point thereon; and locking means on said first and second fastener parts for supporting said first part from said second part with the attachment point on the wall-supported member in substantial alignment with the attachment point on the wall, said locking means comprising an eye on said first fastener part and a catch upstanding from said second fastener part with an upper tip directed toward the wall when said second fastener part is attached to the wall, said eye being receivable over said catch to a position substantially locked beneath said tip and between said catch and the wall.

24. The two-part fastener of claim 23 wherein said first fastener part comprises an eye screw having an elongated shank for attachment to the wall-supported member, said eye being joined to and oriented at an oblique angle relative to the axis of said shank, and wherein said second fastener part comprises a nail member having a head and an elongated shaft for attachment to the wall, said catch being secured to said shaft near said head and projecting in a direction generally normal to the axis of said shaft.

25. A method of hanging a wall-supported member on a wall, comprising the steps of:

providing an elongated template having two substantially mirror image arrays of longitudinally spaced holes formed therein on opposite sides of the longitudinal center thereof and each of said holes of one of said arrays correlated with a corresponding one of said holes of the other of said arrays to provide a plurality of correlated pairs of holes substantially equidistant from the longitudinal center of the template;

aligning the template against a rear face of the wall-supported member generally in parallel with a horizontal axis of the wall-supported member;

longitudinally centering the template relative to the vertical central axis of the wall-supported member;

marking a pair of attachment points on the wall supported member by passing a marking tool through a selected one of said correlated pairs of holes in the template;

orienting the template against the wall in a substantially horizontal attitude;

marking a pair of attachment points on the wall by passing a marking tool through said selected one of said correlated pair of holes in the template;

fastening first and second interengageable parts of a pair of two-part fasteners respectively to the wall-supported member and to the wall at the attachment points marked thereon; and interengaging the first and second fastener parts to hang the wall-supported member from the wall.

26. A template for use in marking fastener attachment points on a wall and a wall-supported member to be hung on the wall, comprising:

an elongated template body having two substantially mirror image arrays of longitudinally spaced holes formed therein on opposite sides of the longitudinal center thereof, said template body including indicia means for correlating each of said holes of one of said arrays with a corresponding one of said holes of the other of said arrays to identify a plurality of correlated pairs of holes substantially equidistant from the longitudinal center of the template body, whereby a selected one of the correlated pairs of holes is usable to mark an identically spaced pair of attachment points on the wall and the wall-supported member.

* * * * *